US011684969B2

(12) United States Patent
Zhi et al.

(10) Patent No.: US 11,684,969 B2
(45) Date of Patent: Jun. 27, 2023

(54) TUNDISH

(71) Applicant: BAOSHAN IRON & STEEL CO., LTD., Shanghai (CN)

(72) Inventors: Jianjun Zhi, Shanghai (CN); Zhengjie Fan, Shanghai (CN); Xufeng Liu, Shanghai (CN); Hua Gao, Shanghai (CN); Zhiqiang Zhang, Shanghai (CN); Guoqiang Liu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 158 days.

(21) Appl. No.: 17/261,972

(22) PCT Filed: Jul. 19, 2019

(86) PCT No.: PCT/CN2019/096762

§ 371 (c)(1),
(2) Date: Jan. 21, 2021

(87) PCT Pub. No.: WO2020/020069

PCT Pub. Date: Jan. 30, 2020

(65) Prior Publication Data

US 2021/0291260 A1 Sep. 23, 2021

(30) Foreign Application Priority Data

Jul. 24, 2018 (CN) ..... 201810818597.9

(51) Int. Cl.

| | |
|---|---|
| ***B22D 1/00*** | (2006.01) |
| ***B22D 11/118*** | (2006.01) |
| ***B22D 41/08*** | (2006.01) |

(52) U.S. Cl.

CPC ..... *B22D 1/005* (2013.01); *B22D 11/118* (2013.01); *B22D 41/08* (2013.01)

(58) Field of Classification Search

None

See application file for complete search history.

(56) References Cited

U.S. PATENT DOCUMENTS 5,004,495 A * 4/1991 Labate ..... B22D 11/118 75/582

5,511,766 A 4/1996 Vassilicos (Continued)

FOREIGN PATENT DOCUMENTS

CN 201186337 Y 1/2009
CN 201186340 Y 1/2009

(Continued)

OTHER PUBLICATIONS

International Search Report dated Oct. 12, 2019 for PCT Patent Application No. PCT/CN2019/096762.

(Continued)

*Primary Examiner* — Scott R Kastler

(74) *Attorney, Agent, or Firm* — Lei Fang, Esq.; Smith Tempel Blaha LLC

(57) ABSTRACT

A tundish, wherein a steel passing hole (43) is provided at a lower portion of a gas-curtain weir refractory body (42); an argon duct (46), a gas chamber (45) and a gas-permeable brick (44) are connected to form a gas-curtain generating device, and the gas-curtain generating device is installed at the lower portion of the gas-curtain weir refractory body (42); the gas-permeable brick (44) is provided in association with the position of the steel passing hole (43), and a length of the gas-permeable brick is designed larger than a width of the steel passing hole (43); and a gas-curtain weir plate (4) is provided in a tundish container, the gas-curtain weir refractory body (42) crosses the tundish container horizontally, and divides the tundish container into a first region and a second region.

14 Claims, 4 Drawing Sheets

(56) References Cited

U.S. PATENT DOCUMENTS

| | | | | |
|---|---|---|---|---|
| 2021/0053111 | A1* | 2/2021 | Smith | B22D 1/002 |
| 2021/0291260 | A1* | 9/2021 | Zhi | B22D 1/002 |

FOREIGN PATENT DOCUMENTS

| | | | |
|---|---|---|---|
| CN | 201693164 | U | 1/2011 |
| CN | 202411396 | U | 9/2012 |
| CN | 106670445 | U | 5/2017 |
| CN | 107350443 | A | 11/2017 |
| FR | 2642679 | A3 | 8/1990 |
| JP | 2005000957 | A | 1/2005 |
| RU | 57165 | U | 10/2006 |

OTHER PUBLICATIONS

Written Opinion dated Oct. 12, 2019 for PCT Patent Application No. PCT/CN2019/096762.
Supplementary European Search Report dated Jun. 15, 2021 for EP 19841788.

* cited by examiner

TUNDISH

CROSS-REFERENCE TO RELATED APPLICATIONS

This application is a 371 U.S. National Phase of PCT International Application No. PCT/CN2019/096762 filed on Jul. 19, 2019, which claims benefit and priority to Chinese patent application no. CN 201810818597.9 filed on Jul. 24, 2018, the contents of both are incorporated by reference herein in their entiries.

TECHNICAL FIELD

The present disclosure relates to a field of tundish metallurgy technology, in particular to a tundish or a device for removing inclusions by blowing argon with a gas-curtain weir plate in a tundish.

BACKGROUND

Tundish gas-curtain wall technology is a technology for removing non-metallic inclusions from molten steel in a tundish. The principle thereof is that a gas-curtain wall is provided at a bottom of a tundish to blow in argon, and the argon passes through the gas-curtain wall and floats upward to form a gas-curtain barrier of argon bubbles, promoting the upward floating and removing of non-metallic inclusions in liquid steel.

However, the existing strip-shaped gas-curtain wall technology has main defects and deficiencies as following:

1) The existing gas-curtain wall has a blind area when generating a gas curtain. Currently, a length of a blind end of most gas-curtain walls is about 90~120 mm. Due to the existence of the blind end of a gas curtain, a removal effect of inclusions is affected.

2) The argon floats right above the strip-shaped gas-curtain wall in the tundish and forms a violent fluctuation, causing an exposure of the molten steel and causing a secondary oxidation of the molten steel. Besides, the argon bubbles drive the inclusions to float upward to a liquid surface of the tundish, while the liquid surface fluctuates greatly. If not being adsorbed by a covering agent, the inclusions will re-enter the molten steel, thereby affecting the removal effect of inclusions;

3) Since the existing gas-curtain wall technology needs to generate a gas curtain in a steel passing section of the whole tundish, needing a certain amount of blowing volume, the argon consumption is large, while a large amount of argon blowing will cause the liquid surface to flip.

Combined with FIG. 1, patent CN201186340 (Application NO.: 200820004824.6) discloses an intermittent cloth-seamed gas-curtain wall. A gas chamber, and a gas gap that connects the gas chamber and a working surface of the gas-curtain wall are formed in the gas-curtain wall, wherein on the working surface of the gas-curtain wall, the gas gap on one same line is intermittent. The deficiencies of the patent are that the producing process is complicated, the cost is high, and the gas curtain has a blind area that affects the removal effect of non-metallic inclusions.

Patent CN201186337Y (Application NO.: 200820004821.2) discloses a tundish gas-curtain wall and a tundish with the gas-curtain wall. The disadvantages are that a blind area of gas curtain exists, the gas curtain causes the liquid surface to fluctuate, and the inclusions re-enter into the molten steel.

Patent CN 107350443 A (Application NO.: 201710576129.0) discloses a method for removing inclusions by blowing argon into a continuous-casting tundish gas-curtain wall. The disadvantages are that a blind area of gas curtain still exists, and a length of the blind area is 30~40 mm, which is unable to completely eliminate the re-entrance of inclusions caused by the fluctuation of the liquid surface.

SUMMARY (1) Technical Problem to be Solved

In view of the above-mentioned deficiencies of the prior art, the present disclosure provides a device for removing inclusions by blowing argon with a gas-curtain weir plate in a tundish. The main problem to be solved by the present disclosure is that a generated gas curtain will not generate a blind area on a steel flow channel.

(2) Technical Solution

A tundish, comprising a long nozzle, a tundish container that is composed of a tundish refractory working layer and a tundish shell, and a submerged nozzle, wherein the tundish also comprises a gas-curtain weir plate, the gas-curtain weir plate comprises a gas-curtain weir refractory body, a steel passing hole, a gas-permeable brick, a gas chamber, and an argon duct; the steel passing hole is provided at a lower portion of the gas-curtain weir refractory body, the argon duct is connected to the gas chamber, the gas chamber is connected to the gas-permeable brick to form a gas-curtain generating device, and the gas-curtain generating device is installed at a lower portion of the gas-curtain weir refractory body; the gas-permeable brick is provided in association with the position of the steel passing hole, and a length of the gas-permeable brick is designed larger than a width of the steel passing hole to provide a gas-curtain that fully covers all liquid steel flowing to or flowing through the steel passing hole; the gas-curtain weir plate is provided in the tundish container, the gas-curtain weir refractory body crosses the tundish container horizontally, dividing the tundish container into a first region and a second region, molten steel is injected into the first region of the tundish container from the long nozzle, flows into the second region of the tundish container under a diversion of the steel passing hole, and flows out of the tundish container from the submerged nozzle, the steel passing hole forms a unique flow channel of liquid steel between the first region and the second region.

A device for removing inclusions by blowing argon with a gas-curtain weir in a tundish, comprising the tundish that is provided with a long nozzle, a tundish refractory working layer, a tundish shell, and a submerged nozzle, wherein a middle of the tundish is provided with one gas-curtain weir plate, and the gas-curtain weir plate comprises a hoist ring, a gas-curtain weir refractory body, a steel passing hole, a gas-permeable brick, a gas chamber and an argon duct; the hoist ring is fixedly installed at an upper portion of the gas-curtain weir refractory body, and the steel passing hole are provided at a lower portion of the gas-curtain weir refractory body, the argon duct is connected to the gas chamber, the gas chamber is connected to the gas-permeable brick to form a gas-curtain generating device that is installed at the lower portion of the gas-curtain weir refractory body.

The gas-curtain weir plate is provided in the middle of the tundish to divide the tundish into a mixing region and a casting region, wherein molten steel is injected from the long nozzle into the mixing region of the tundish, flows into a stream region of the tundish through a diversion steel passing hole of the gas-curtain weir, and flows into a crystallizer from the submerged nozzle; a gas-curtain generating device is provided at an entrance of the steel passing hole of the gas-curtain weir plate, and argon is blown in to form a gas curtain without a blind area at the entrance of the steel passing hole, gas washing the liquid steel that flows through the steel passing hole to promote the accumulation and upward floating of inclusions.

According to an embodiment of the present disclosure, the gas-curtain weir plate is provided at a position of ½ to ¼ of a length of the tundish.

According to an embodiment of the present disclosure, two steel passing holes are provided at a position that is 0~500 mm above a bottom of the gas-curtain weir plate.

According to an embodiment of the present disclosure, the steel passing hole is designed rectangular, the size of which is length (50~300 mm)×width (50~300 mm), or circular with a diameter (50~300 mm), and an inclination of the steel passing hole is designed upward (0~80 degrees).

According to an embodiment of the present disclosure, a length of the gas-permeable brick is designed larger than a length of the steel passing hole, and the length of the gas-permeable brick is designed to be 50~320 mm.

According to an embodiment of the present disclosure, the gas-curtain generating device is provided at an entrance of the steel passing hole or a bottom of the steel passing hole or an exit of the steel passing hole of the gas-curtain weir plate.

According to an embodiment of the present disclosure, the argon duct is provided with a pressure and flow control device, an argon working pressure is selected to be 0.1~0.9 MPa, and an argon blowing rate is 5~50 L/min.

(3) Beneficial Effect

By adopting the technical proposals of the present disclosure, the tundish or the device for removing inclusions by blowing argon with a gas-curtain weir in the tundish has the following effects: by arranging a strip-shaped gas-curtain generating device at a position of the entrance of the weir plate, and designing the length of the gas-permeable brick larger than the length of the steel passing hole, all molten steel flowing through the steel passing hole of the weir plate is guaranteed an effective gas washing, and no blind area of a gas curtain will exist, ensuring the removal efficiency of inclusions in the molten steel;

as long as a gas curtain is formed at the entrance of the weir plate, since the area of the steel passing hole of the weir plate is very small, which is beneficial to improve the efficiency of blowing purge, and the disclosure is thereby beneficial to reduce the argon consumption in an actual production;

during a using process, since the disclosure is beneficial to reduce the argon flow rate, it is thereby beneficial to reduce a molten steel exposure in the molten steel, thereby beneficial to reduce the secondary oxidation of the molten steel;

during the using process, the steel passing hole guides the molten steel to flow quickly in a horizontal direction, the argon driving the purging also flows horizontally to achieve a more evenly ventilation in the second region of the tundish container, so as to also benefit to reduce the molten steel exposure in the molten steel, thereby reducing the secondary oxidation of the molten steel;

by providing a gas-curtain weir plate in a main device to divide the tundish into two regions, the fluctuation of liquid surface in the first region can be made smaller, and less slags in the first region will be involved.

BRIEF DESCRIPTION OF THE DRAWINGS

In this disclosure, the same reference signs always indicate the same features, wherein.

REFERENCE SIGNS

Figure 1:
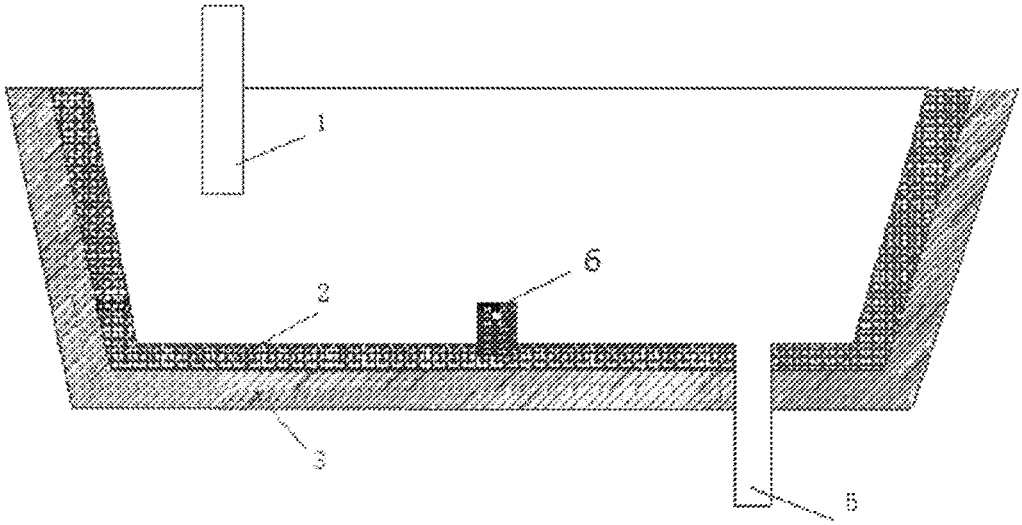
FIG.1 (Prior Art)
FIG. 1 (Prior Art) is a structural diagram of an existing tundish gas-curtain dam.

1: long nozzle; 2: tundish refractory; 3: tundish shell; 4: gas-curtain weir plate; 5: submerged nozzle; 6: gas-curtain dam; 41: hoist ring; 42: gas-curtain weir refractory body; 43: steel passing hole; 44: gas-permeable brick; 45: gas chamber; 46: argon duct.

DETAILED DESCRIPTION OF EMBODIMENTS

The technical proposals of the present disclosure is described further below with reference to the drawings and embodiments.

A device for removing inclusions by blowing argon with a gas-curtain weir in a tundish, or a tundish, comprises a tundish with a long nozzle 1, a tundish refractory working layer 2, a tundish shell 3, one gas-curtain weir plate 4 that is provided in a middle position of the tundish, a submerged nozzle 5, wherein the tundish refractory working layer 2 and the tundish shell 3 compose a tundish container. It can be seen from FIG. 2 and FIG. 3 that the horizontal distances between the transverse walls (the left and right walls in FIG. 2) or between the vertical walls (the left and right walls in FIG. 3) of the tundish refractory working layer are both wide upside, and narrow downside. The gas-curtain weir plate 4 comprises a hoist ring 41, a gas-curtain weir refractory body 42, steel passing holes 43, gas-permeable bricks 44, a gas chamber 45, and an argon duct 46. The hoist ring 41 is fixedly installed at an upper portion of the gas-curtain weir refractory body 42, while the steel passing holes 43 are provided at a lower portion of the gas-curtain weir refractory body 42. The argon duct 46 is connected to the gas chamber 45, and the gas chamber 45 is connected to the gas-permeable bricks 44 to form a gas-curtain generating device, which is installed at the lower portion of the gas-curtain weir refractory body 42.

Figure 2:
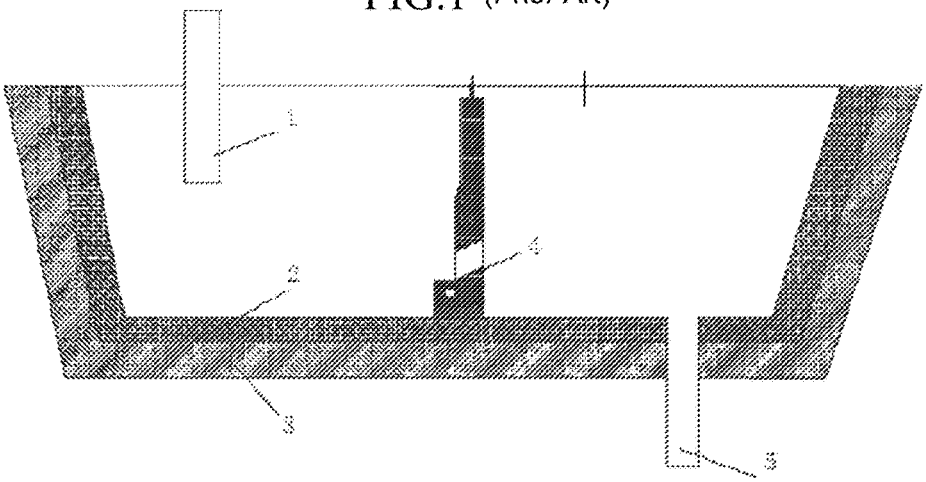
FIG. 2 is a structural diagram of a device according to embodiment 1 of the present disclosure.
Figure 3:
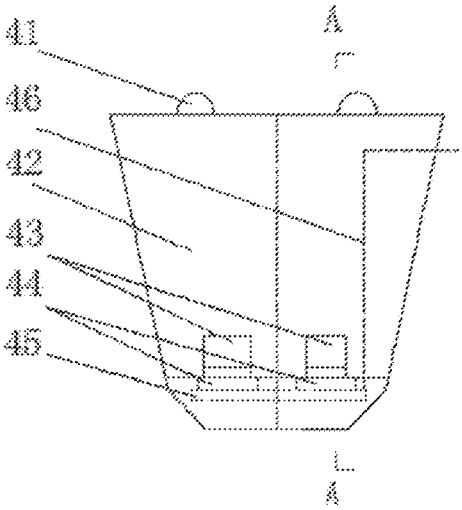
FIG. 3 is a structural diagram of a gas-curtain weir plate according to embodiment 1.
Figure 5:
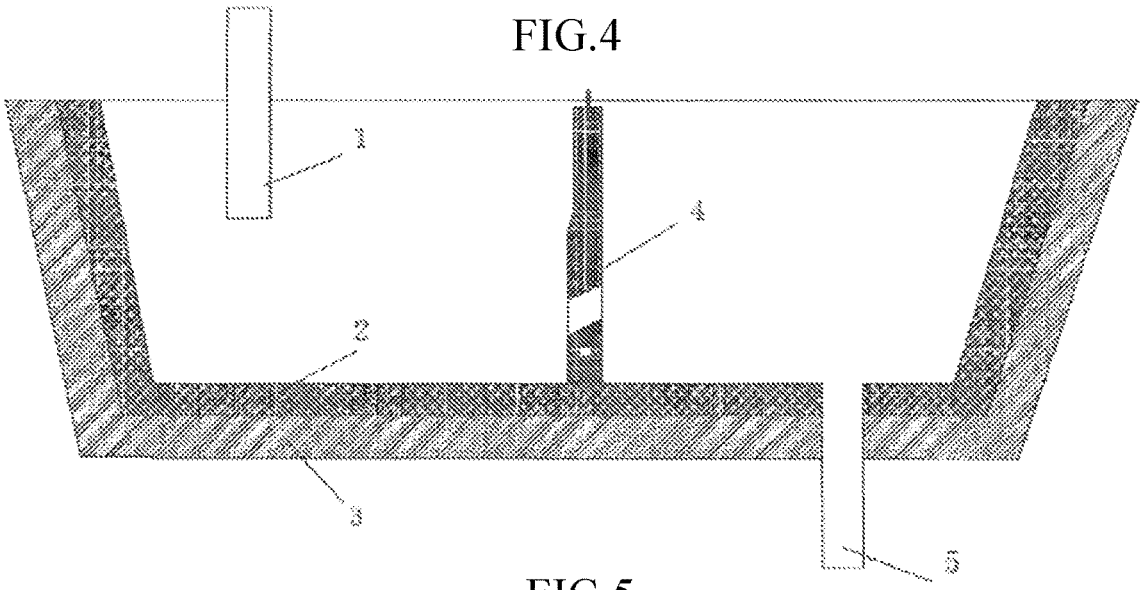
FIG. 5 is a structural diagram of a device according to embodiment 2 of the present disclosure.
Figure 8:
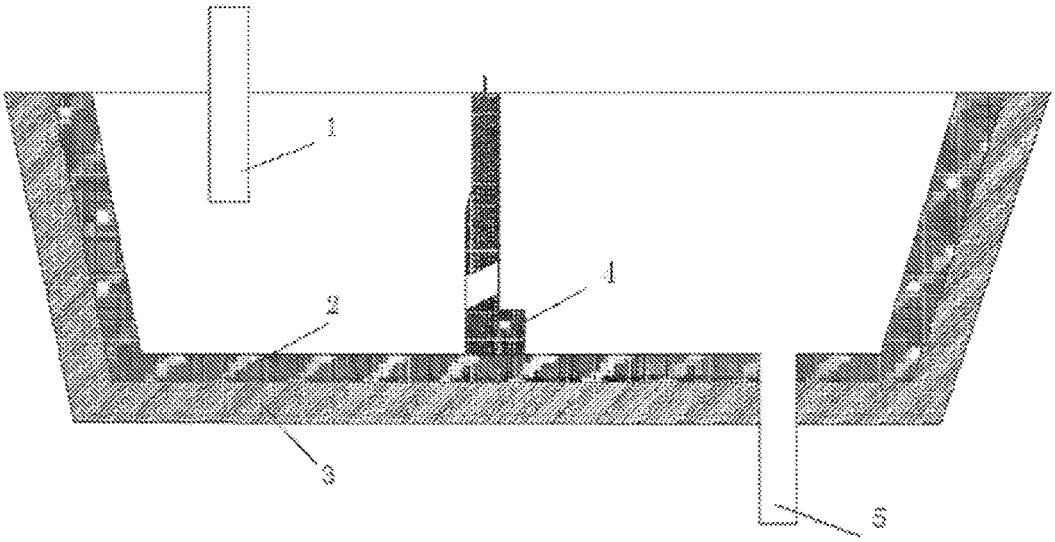
FIG. 8 is a structural diagram of a device according to embodiment 3 of the present disclosure.

The gas-curtain weir plate is provided at a position of ½, or ½ to ¼, in a length direction of the tundish, dividing the tundish container into a first region (the left area) and a second region (the right area) as shown in FIG. 2, FIG. 5 or FIG. 8. As shown in FIG. 8, when the gas-curtain weir plate is at a position that is less than ½ in the length direction of the tundish, a length of the first region is smaller than a length of the second region. The size of the steel passing hole is designed according to the actual steel passing quantity. The steel passing hole is designed rectangular with a size of length (50~300 mm)×width (50~300 mm), or circular with a diameter (50~300 mm), or other shaped. The inclination angle of the steel passing hole is designed upward (0~80 degrees). The molten steel flows upward under a diversion of the steel passing holes, thereby beneficial to the upward floating of inclusions. The number of the steel passing holes is not limited and may be at least one. The argon duct is equipped with a pressure and flow control device. During a producing process, the argon working pressure is selected to be 0.1~0.9 MPa, and the argon blowing rate is 5~50 L/min.

In the embodiment shown in FIG. 2 and FIG. 5, the gas-curtain weir plate 4 is provided in a middle position of the tundish to divide the tundish into a first region (also called as a mixing region) and a second region (also called as a casting region). The molten steel is injected from the long nozzle 1 into the mixing region of the tundish (the left side of the tundish), flows into a stream region of the tundish (the right side of the tundish) under the diversion of the steel passing holes 43 of the gas-curtain weir plate 4, and then flows into a crystallizer from the submerged nozzle 5. A gas-curtain generating device is installed at the entrance of the steel passing holes 43 of the gas-curtain weir plate 4. The gas-curtain generating device is composed of an argon-blowing duct 46, a gas chamber 45 and gas-permeable bricks 44. Since the steel passing holes 43 are the unique flow channel between the first region and the second region, and the length of the gas-permeable bricks 44 is larger than the width of the steel passing holes 43, the positions of which are provided in association to make the gas curtain, formed by the exhaust from the gas-permeable bricks, fully covers all liquid steel that flows through the steel passing holes, the argon blown into thereby forms a gas curtain with no blind area at the entrance of the steel passing holes 43, performing a gas washing to the liquid steel that flows through the steel passing holes 43, so as to promote the accumulation and upward floating of inclusions.

Embodiment 1

Figure 4:
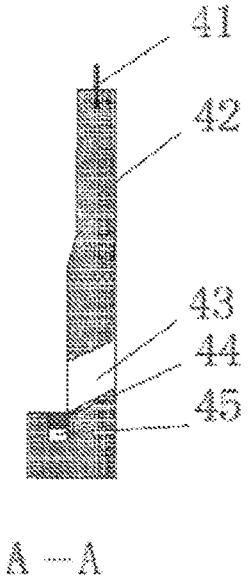
FIG. 4 is an A-A cross-sectional view of the gas-curtain weir plate according to embodiment 1.

Combined with FIG. 2, a 60-ton tundish on site is provided with a long nozzle 1, a tundish refractory layer 2, a tundish shell 3, a gas-curtain weir plate 4, and a submerged nozzle 5. The gas-curtain weir plate 4 is provided at a ½ position of the length of the tundish. Combined with FIG. 3 and FIG. 4, two steel passing holes 43 are provided above a bottom of the gas-curtain weir plate 4. The size of the steel passing holes 43 is 150 mm in length×100 mm in height, with an inclination angle of 45 degrees upward. A gas-curtain generating device is installed at an entrance (the left side) of the steel passing holes 43 of the gas-curtain weir plate 4. The gas-curtain generating device is composed of an argon-blowing duct 46, a gas chamber 45 and gas-permeable bricks 44, wherein the argon duct 46 is connected to the gas chamber 45 and the gas chamber 45 is connected to the gas-permeable bricks 44, a length of gas-permeable brick 44 is designed larger than a length of the steel passing hole 43, and the length of the gas-permeable bricks 44 is designed to be 50~320 mm. A top surface of the gas-permeable bricks 44 is flush with a bottom of the entrance (the left side) of the steel passing holes 43, while existing at least one variant. For example, the position of the top surface of the gas-permeable brick 44 is lower than the bottom of the entrance side of the steel passing holes 43, or the top surface of the gas-permeable bricks 44 is higher than the bottom of the entrance side of the steel passing holes 43. The position of the steel passing holes 43 can be provided 0~500 mm above the bottom of the gas-curtain weir plate 4.

Before pouring, the argon of the argon duct 46 of the gas-curtain weir plate 4 is opened. The argon working pressure is 0.5 MPa, and the argon blowing rate is 6 L/min. The blown-in argon forms a gas curtain without a blind area at the entrance (the left side) of the steel passing holes 43.

The starting molten steel is poured into the mixing region of the tundish (the left side of the tundish) from the long nozzle 1, flows into the stream region of the tundish (the right side of the tundish) through the diversion steel passing holes 43 of the gas-curtain weir plate 4, and then flows into the crystallizer from the submerged nozzle 5.

The argon, blown in from the gas-permeable bricks 44 on the gas-curtain weir plate 4, performs a full coverage gas washing to the liquid steel that flows through the steel passing holes 43, to promote the accumulation and upward floating of inclusions. Since the amount of the blown-in argon is little, it will not cause the molten steel churning and exposing that may cause a secondary oxidation of molten steel and a re-entrance of inclusions.

Embodiment 2

Figure 6:
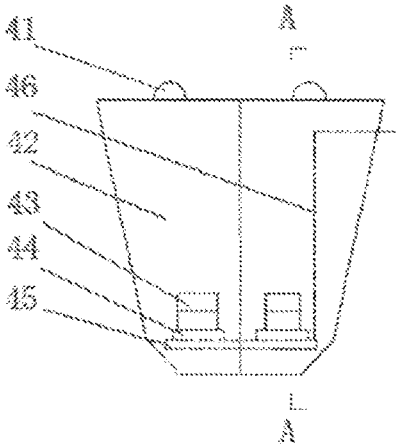
FIG. 6 is a structural diagram of a gas-curtain weir plate according to embodiment 2.
Figure 7:
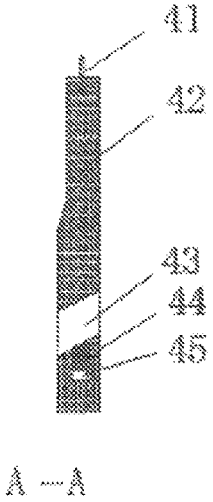
FIG. 7 is an A-A cross-sectional view of the gas-curtain weir plate according to embodiment 2.

Combined with FIG. 5, a 60-ton tundish on site is provided with a long nozzle 1, a tundish refractory layer 2, a tundish shell 3, a gas-curtain weir plate 4, and a submerged nozzle 5. The gas-curtain weir plate 4 is provided at a ½ position of the length of the tundish. Combined with FIG. 6 and FIG. 7, two steel passing holes 43 are provided 0~500 mm above a bottom of the gas-curtain weir plate 4. The size of the steel passing holes 43 is 150 mm in length×100 mm in height, with an inclination angle of 60 degrees upward. A gas-curtain generating device is provided at a bottom of the steel passing holes 43 of the gas-curtain weir plate 4. The gas-curtain generating device is composed of an argon-blowing duct 46, a gas chamber 45 and gas-permeable bricks 44, wherein the argon duct 46 is connected to the gas chamber 45 and the gas chamber 45 is connected to the gas-permeable bricks 44, a length of the gas-permeable brick 44 is designed larger than a length of the steel passing hole 43, and the length of the gas-permeable bricks 44 is designed to be 50~320 mm. A top surface of the gas-permeable bricks 44 forms a part of the bottom surface of the steel passing holes 43.

Before pouring, the argon of the argon duct 46 of the gas-curtain weir plate 4 is opened. The argon working pressure is 0.5 MPa, and the argon blowing rate is 3 L/min. The blown-in argon forms a gas curtain without a blind area inside the steel passing holes 43.

The starting molten steel is poured into the mixing region of the tundish (the left side of the tundish) from the long nozzle 1, flows into the stream region of the tundish (the right side of the tundish) through the diversion steel passing holes 43 of the gas-curtain weir plate 4, and then flows into the crystallizer from the submerged nozzle 5.

The argon, blown in from the gas-permeable bricks 44 on the gas-curtain weir plate 4, performs a full coverage gas washing to the liquid steel that flows through the steel passing holes 43, to promote the accumulation and upward floating of inclusions. Since the amount of the blown-in argon is little, it will not cause the molten steel churning and exposing that may cause a secondary oxidation of molten steel and a re-entrance of inclusions.

Embodiment 3

Figure 9:
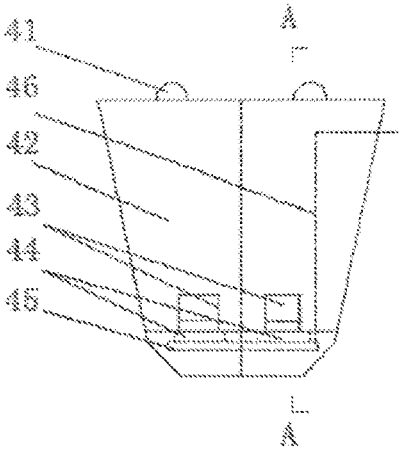
FIG. 9 is a structural diagram of a gas-curtain weir plate according to embodiment 3.
Figure 10:
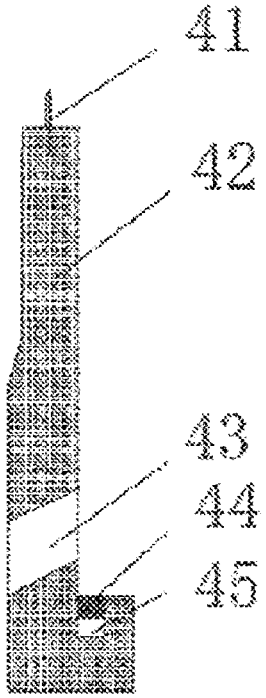
FIG. 10 is an A-A cross-sectional view of the gas-curtain weir plate according to embodiment 3.

Combined with FIG. 8, a 60-ton tundish on site is provided with a long nozzle 1, a tundish refractory layer 2, a tundish shell 3, a gas-curtain weir plate 4, and a submerged nozzle 5. The gas-curtain weir plate 4 is provided at a ½ position of the length of the tundish. Combined with FIG. 9 and FIG. 10, two steel passing holes 43 are provided 0~500 mm above a bottom of the weir plate. The size of the steel passing holes 43 is 150×100 mm with an inclination angle of 45 degrees upward. A gas-curtain generating device is provided at an exit (the right side) of the steel passing holes 43 of the gas-curtain weir plate 4. The gas-curtain generating device is composed of an argon-blowing duct 46, a gas chamber 45 and gas-permeable bricks 44, wherein the argon duct 46 is connected to the gas chamber 45 and the gas chamber 45 is connected to the gas-permeable bricks 44, a length of the gas-permeable brick 44 is designed larger than a length of the steel passing hole 43, and the length of the gas-permeable bricks 44 is designed to be 50~320 mm. A top surface of the gas-permeable bricks 44 is lower than a bottom of the exit side (the right side) of the steel passing holes 43.

Before pouring, the argon of the argon duct 46 of the gas-curtain weir plate 4 is opened. The argon working pressure is 0.5 MPa, and the argon blowing rate is 8 L/min. The blown-in argon forms a gas curtain without a blind area at the exit (the right side) of the steel passing holes 43.

The starting molten steel is poured into the mixing region of the tundish (the left side of the tundish) from the long nozzle 1, flows into the stream region of the tundish (the right side of the tundish) through the diversion steel passing holes 43 of the gas-curtain weir plate 4, and then flows into the crystallizer from the submerged nozzle 5.

The argon, blown in from the gas-permeable bricks 44 on the gas-curtain weir plate 4, performs a full coverage gas washing to the liquid steel that flows through the steel passing holes 43, to promote the accumulation and upward floating of inclusions. Since the amount of blown-in argon is little, it will not cause the molten steel churning and exposing that may cause a secondary oxidation of molten steel and a re-entrance of inclusions.

In the Embodiments 1 and 3, the gas chamber 45 and the gas-curtain weir refractory body 42 are integrated or integrally formed, while existing at least one variant, that is, the gas chamber 45 and the gas-curtain weir refractory body 42 are separate, and the gas chamber 45 can also have a certain nozzle with the gas-curtain weir refractory body 42, at least the gas curtain generated by the gas-permeable bricks 44 provided on the gas chamber 45 can fully cover the liquid steel flowing to or flowing through the steel passing holes.

In summary, by adopting the technical proposals of the present disclosure, according to the embodiments of the present disclosure, the tundish or the device for removing inclusions by blowing argon with a gas-curtain weir in the tundish has the following effects.

(1) By providing a gas-curtain weir plate in the main device to divide the tundish into a mixing region and a stream region, the fluctuation of the liquid surface in the casting region can be made smaller, and less slags from the casting region will be involved. By providing two diversion holes in the middle of the weir plate, the molten steel flows upward through the diversion holes, thereby facilitating the upward floating of inclusions.

(2) By providing a strip-shaped gas-curtain generating device at the position of the entrance of the weir plate, and designing the length of the gas-permeable bricks is larger than the length of the steel passing holes, an effective gas washing is ensured to all molten steel that flows through the steel passing holes of the weir plate, and no blind area of the gas-curtain exists, thereby ensuring the removal efficiency of inclusions in molten steel.

(3) As long as a gas curtain is formed at the entrance of the weir plate, since the area of the steel passing holes of the weir plate is very small, the purging efficiency is improved, which is beneficial to reduce the blowing volume, so as to benefit to reduce the molten steel exposure in the molten steel, thereby beneficial to reduce the secondary oxidation of the molten steel.

(4) During the using process, the steel passing holes guide the liquid steel to flow quickly in a horizontal direction, driving the purging argon also flows horizontally to achieve a more evenly ventilation in the second region of the tundish container, so as to also benefit to reduce the molten steel exposure caused in the molten steel, thereby reducing the secondary oxidation of the molten steel.

The invention claimed is:

1. A method for removing inclusions from molten steel in a tundish comprising injecting molten steel into a first region of a tundish container from a long nozzle;

allowing the molten steel in the first region flow into a second region of the tundish container;

providing argon by a gas-curtain generating device to form gas curtain without a blind area to gas wash the molten steel that flows through a steel passing hole to promote accumulation and upward floating of inclusions; and wherein working pressure of the argon is selected to be 0.1-0.9 MPa, and an argon blowing rate is 5-50 L/min.

2. The method of claim 1, wherein the tundish comprises the long nozzle, the tundish container, a submerged nozzle, and a gas-curtain weir plate that comprises a gas-curtain weir refractory body, the steel passing hole, a gas-permeable brick, a gas chamber, and an argon duct; wherein the steel passing hole is provided at a lower portion of the gas-curtain weir refractory body, the argon duct is connected to the gas chamber, the gas chamber is connected to the gas-permeable brick to form a gas-curtain generating device, and a gas-curtain generating device is installed at the lower portion of the gas-curtain weir refractory body.

3. The method of claim 2, wherein the gas-permeable brick is provided in association with the position of the steel passing hole, and a length of the gas-permeable brick is larger than a width of the steel passing hole to provide a gas curtain that fully covers all liquid steel flowing to or flowing through the steel passing hole.

4. The method of claim 2, wherein the gas-curtain weir plate is provided in the tundish container, the gas-curtain weir refractory body crosses the tundish container horizontally and divides the tundish container into the first region and the second region.

5. The method of claim 4, wherein molten steel is injected into the first region of the tundish container from the long nozzle, flows into the second region of the tundish container under a diversion of the steel passing hole, and flows out of the tundish container from the submerged nozzle, and wherein the steel passing hole forms a unique flow channel of liquid steel between the first region and the second region.

6. The method of claim 1, wherein the gas-curtain generating device is provided on an entrance side of the steel passing hole of the gas-curtain weir plate, and a position of a top surface of the gas-permeable brick is not higher than a bottom of the steel passing hole.

7. The method of claim 1, wherein from an entrance side to an exit side of the steel passing hole, an inclination of the steel passing hole is designed upward.

8. The method of claim 2, wherein the gas-curtain generating device is provided on the entrance side of the steel passing hole of the gas-curtain weir plate, and a position of a top surface of the gas-permeable brick is flush with a bottom of the entrance side of the steel passing hole.

9. The method of claim 2, wherein the gas-curtain generating device is provided on an entrance side of the steel passing hole of the gas-curtain weir plate, and a top surface of the gas-permeable brick is lower than a bottom of an exit side of the steel passing hole.

10. The method of claim 2, wherein the gas-curtain generating device is provided on an entrance side of the steel passing hole of the gas-curtain weir plate, and a top surface of the gas-permeable brick forms a part of a bottom surface of the steel passing hole.

11. The method of claim 2, wherein the gas chamber and the gas-curtain weir refractory body are integrated or integrally set.

12. The method of claim 2, wherein the gas-curtain weir plate is provided at a position of ½, or ½ to ¼, in a length direction of the tundish, and a length of the first region is less than a length of the second region.

13. The method of claim 2, wherein the gas-curtain weir refractory body crosses horizontally between two vertical inner walls of the tundish refractory working layer, and horizontal distances between the two vertical inner walls is wide upside and narrow downside.

14. The method of claim 1, wherein the steel passing hole is designed rectangular, the size of which is length (50-300 mm)×width (50-300 mm), or circular with a diameter (50-300 mm).

* * * * *